US008555600B2

(12) United States Patent
Cortina-Cordero et al.

(10) Patent No.: US 8,555,600 B2
(45) Date of Patent: Oct. 15, 2013

(54) METHOD FOR MOUNTING IN SECTIONS AN ANNULAR TOWER FOR WIND POWER GENERATOR, HELIOSTATIC POWER GENERATOR OR CHIMNEY COMPOSED FROM THREE CONCRETE SEGMENTS OR MORE

(75) Inventors: Alejandro Cortina-Cordero, Mexico City (MX); Jose Pablo Cortina Ortega, Mexico City (MX); Jose Pablo Cortina Cordero, Mexico City (MX)

(73) Assignee: Cortina Innovations, S.A. de C.V., Mexico City (MX)

( * ) Notice: Subject to any disclaimer, the term of this patent is extended or adjusted under 35 U.S.C. 154(b) by 738 days.

(21) Appl. No.: 12/619,454

(22) Filed: Nov. 16, 2009

(65) Prior Publication Data

US 2010/0139181 A1 Jun. 10, 2010

Related U.S. Application Data

(60) Provisional application No. 61/121,381, filed on Dec. 10, 2008.

(51) Int. Cl.

| | |
|---|---|
| ***E04H 12/34*** | (2006.01) |
| ***E04H 12/00*** | (2006.01) |
| ***E04C 5/08*** | (2006.01) |
| ***E02D 27/42*** | (2006.01) |
| ***E04B 1/00*** | (2006.01) |
| ***E04G 21/00*** | (2006.01) |

(52) U.S. Cl.
USPC ... 52/745.18; 52/123.1; 52/223.4; 52/169.13; 52/651.07; 52/745.03

(58) Field of Classification Search
USPC ..... 52/117, 119, 120, 123.1, 169.13, 223.4, 52/649.2, 651.01, 651.02, 651.05, 651.07, 52/745.03, 745.04, 745.17, 745.18
See application file for complete search history.

(56) References Cited

U.S. PATENT DOCUMENTS

| | | | | |
|---|---|---|---|---|
| 4,045,929 | A | 9/1977 | Velo Dalbrenta | |
| 4,365,618 | A | 12/1982 | Jones | |
| 5,109,953 | A | 5/1992 | Mathis | |
| 7,160,085 | B2 | 1/2007 | de Roest | |
| 7,739,843 | B2 * | 6/2010 | Cortina-Cordero | 52/223.5 |

(Continued)

FOREIGN PATENT DOCUMENTS

| | | | |
|---|---|---|---|
| DE | 20 2007 003 842 | U1 | 5/2007 |
| EP | 0 960 986 | A2 | 1/1999 |
| EP | 1 876 316 | A1 | 1/2008 |
| JP | 2008127766 | A * | 6/2008 |

OTHER PUBLICATIONS

Windblatt, The Enercon Magazine, Huge Building Blocks, exemplar Mar. 2001, Sep. 22, 2201, pp. 8-9.

*Primary Examiner* — Ryan Kwiecinski
(74) *Attorney, Agent, or Firm* — Birch, Stewart, Kolasch & Birch, LLP

(57) ABSTRACT

A method for erecting a pre-stressed sectionalized and segmented concrete tower for wind power or heliostatic generator or chimney is provided. The method includes the step of providing a plurality of assembling supports and lifting harnesses in order to support to the concrete segments for assembling concrete section from the concrete segments using a small capacity crane, and installing, with a high capacity crane the assembled concrete sections to conform the concrete tower. The lifting harness provides safety scaffolds for personnel during prestressing.

7 Claims, 7 Drawing Sheets

(56) References Cited

U.S. PATENT DOCUMENTS

| | | | | |
|---|---|---|---|---|
| 7,765,766 | B2 * | 8/2010 | Gomez et al. | 52/745.04 |
| 7,770,343 | B2 * | 8/2010 | Montaner Fraguet et al. | 52/223.5 |
| 8,104,242 | B1 * | 1/2012 | Fouad et al. | 52/223.4 |
| 2003/0000165 | A1 * | 1/2003 | Tadros et al. | 52/223.4 |
| 2004/0074171 | A1 | 4/2004 | Wobben | |
| 2004/0253109 | A1 | 12/2004 | Wobben | |
| 2006/0114279 | A1 | 6/2006 | Iwao | |
| 2006/0156681 | A1 * | 7/2006 | Fernandez Gomez et al. | 52/721.1 |
| 2006/0213145 | A1 * | 9/2006 | Haller | 52/651.01 |
| 2006/0220386 | A1 | 10/2006 | Wobben | |
| 2006/0225379 | A1 * | 10/2006 | Seidel et al. | 52/726.3 |
| 2008/0040983 | A1 * | 2/2008 | Fernandez Gomez et al. | 52/40 |
| 2008/0209842 | A1 * | 9/2008 | Montaner Fraguet et al. | 52/651.07 |
| 2008/0302038 | A1 | 12/2008 | Wobben | |
| 2009/0031639 | A1 * | 2/2009 | Cortina/Cordero | 52/40 |
| 2009/0107062 | A1 * | 4/2009 | Pedersen | 52/223.13 |

* cited by examiner

METHOD FOR MOUNTING IN SECTIONS AN ANNULAR TOWER FOR WIND POWER GENERATOR, HELIOSTATIC POWER GENERATOR OR CHIMNEY COMPOSED FROM THREE CONCRETE SEGMENTS OR MORE

CROSS-REFERENCE TO RELATED APPLICATIONS

This non-provisional application claims priority under 35 U.S.C. §119(e) on U.S. Provisional Application No. 61/121,381, filed on Dec. 10, 2008, the entirety of which is incorporated herein by reference.

BACKGROUND OF THE INVENTION

1. Field of the Invention

This invention relates to a method for mounting a segmented pre-stressed concrete tower for wind power generators and chimneys. Particularly, this application relates to a prestressed concrete tower for wind-power or heliostatic generators, particularly pre-stressed sectioned and segmented concrete tower for wind power or heliostatic generators, and its erecting method, as well as a tower section assembling support and a lifting harness for erecting the tower or chimney.

2. Description of the Related Art

Towers of several designs have been proposed for wind-power or heliostatic generators. For example, several different towers have been built, having structures based on metallic armatures; also, they have been built with tubular sections. In both cases, their height is limited because of their dimensions, the turbulence caused by the air, their strength against intense earthquakes, and their ease of building, because in many cases it is not practical for the heights presently used. Towers made of concrete using sliding formworks are also known. For example the tower of Mathis U.S. Pat. No. 5,109,953. According to such techniques, the tower is built by pouring concrete on formworks placed on the structure.

Other well known concrete structures are made of prestressed concrete. Prestressed concrete is a technique using prestressing tendons—generally of high tensile steel cable or rods—to provide a clamping load which produces a compressive stress that reinforce the concrete structure. The prestressed concrete encompasses pre-tensioned concrete—wherein concrete is cast around already tensioned tendons-, and post-tensioned concrete, wherein the concrete is cast around a duct and after the curing process, compression is applied through prestressing tendons introduced within such ducts.

European patent application EP-A-0 960 986 ARAND, describes a sectioned concrete tower for wind-power generators. According to this publication, prefabricated truncated conical sections are mounted using a crane to form the tower and joined together through pre-stressing tendons. According to the publication, towers of two hundred meters' height, or more, can be erected in this way. International Patent Application WO-2004/007955 WOBBEN, from ENERCON, discloses a construction system for conical sectioned towers. This publication describes the controlled manufacture of each concrete section. The concrete section includes a series of ducts for prestressing. According to WINDBLATT, THE ENERCON MAGAZINE, Huge Building Blocks, exemplar March 2001, Sep. 22, 2201, pages 8-9, it is stated that due to their dimensions, the first pre-cast sections are divided in halves. The main drawback of the ENERCON tower is that the sections are big and heavy and so that, difficult to handle. For mounting them it requires of expensive high capacity cranes. In addition if the sections are made according to Arand, some different formwork or molds parts are required for molding each tower section.

International patent application WO-2003069099 (& U.S. Pat. No. 7,160,085 & EP-1 474 579) and DE-20 2007 003 842 U (& WO-08110309) assigned to MECAL discloses a hybrid tower for wind power generators comprising: (a) a lower portion made of a sectioned (tower divided in sections) segmented (sections divided in segments) annular pre-stressed concrete structure and an upper metallic tubular portion.

MECAL (WO-2003069099), CONCRET & STEEL (WO-2006111597 & EP-1 876 3161 & ES2246734) a subsidiary of GAMESA EOLICA, and INNEO (US-2006156681 & ES-1058539U) a subsidiary of ACCIONA EOLICA disclose a cylindrical tapered tower. The mounting method has many drawbacks, for example, the tower requires very complex joints for joining the segments—see FIGS. 13a to 13d of patent WO-2003069099-. It should be noted that segments of 12 meters height and some tons weight can be easily assembled at the floor level; however at 30 meters height it is not easy to joint the segments with the required precision. In addition, the MECAL joint must be cemented which makes the erection more complex. Furthermore, the segments are made using different molds and it is probable that the segments cannot coincide. Moreover, presstressing in the inner side of the tower—as suggested by MECAL—is non recommendable since it produces weakness in the tower. Bolt connections for joining the concrete segments are also non recommendable since any movement of the tower—an earthquake, for instances—produce movement in the tower segments that can destroy such bolts. In addition, according to the description, the erection of the tower is supposed to be reach by the use of a climbing crane. The use of such crane requires that the tower be over-designed in order to support its own weight as well as the weight of crane and it is difficult to handle at high levels—more than 30 meters—.

Summarizing, the segmented concrete conical towers of the prior art, each share the following drawbacks:

a) The ENERCON, MECAL, CONCRETE & STEEL and INNEO towers are tapered having a circular cross-section. It is to say that the bottom has a higher diameter than the top of the tower. Such design requires one mold for each segment. Because there are a number of different molds, the joining of the pieces is a difficult factor, requiring complex devices to accomplish such joining.

b) Furthermore, in the case of MECAL, the concrete segments are manufactured in a facility and then transported to the building site. Because of their sizes, such segments are big and heavy. The transportation to the site of these pre-fabricated segments, which can weigh more than 60 metric tons, must be carefully planned, using thereby big cranes and flat-cars adequate for their size.

With respect of the mounting methods of segmented concrete towers of the prior art, they share the following drawbacks:

a) In the case of ENERCON, CONCRETE & STEEL and INNEO towers, the erection of these sections must be done with large-capacity cranes, able to lift complete concrete tower sections. Mounting such concrete segments demands a considerable quantity of time and it is also difficult to keep the segments in an exact position to provide the required joints of the concrete segments. The mounting according to the prior art is also affected for the weather conditions, particularly the wind. Usually some time is lost by waiting the appropriate weather conditions for conducting the necessary mounting works. In addition, for mounting segments at high levels of height it is required to provide scaffolds for the working personnel as well as special security kits, which influences the cost of said erection.

b) In the case of MECAL, which uses a climbing crane, the concrete tower must be over dimensioned in order that the lower sections support the weight of the crane as well as the upper concrete segments. Furthermore, by the use of such method it is not possible to obtain the required precision joint of adjacent concrete segments.

The tower of the invention and the mounting method can also be used for heliostatic applications. A concrete tower for solar or heliostatic generation systems is disclosed in U.S. Pat. No. 4,365,618. The concrete tower of the present invention provides a better performance if compared with the metallic towers which are subjected to tremendous thermal expansion.

SUMMARY OF THE INVENTION

It is therefore the object of the present invention to provide a method for erecting a segmented tower, including the pyramidal towers of the present invention and the circular cross-sectional towers of the prior art.

The structural integrity of the tower is achieved by means of vertical prestressing tendons which attach the overlying adjacent segments to the foundation and also horizontal prestressing tendons to join lateral adjacent segments.

An object of the invention is the erection of a sectioned and segmented concrete tower for wind power generators, heliostatic generators or chimneys—of more than 40 meters height, comprising a first lower concrete portion, having an annular cross-section, being formed from three or more concrete segments per section, such sections of a weight which is at least ⅙ weight of the first lower concrete portion of the tower.

Other object of the invention is to provide a method and reusable assembling support for mounting complete sections of the tower formed by at least three concrete segments, such sections being assembled at the ground level through the use of an adjustable harness through which every segment of a tapered section of the tower is placed to its exact position. Said assembling support includes scaffolds to access to the different height of the section in order to provide pre-stressing to the concrete segments. A section of the tower comprising at least three segments is lift and mounted to its final height and position through the use of a crane. Then the assembling support is disengage from the assembled concrete section and used again for assembling and mounting other concrete section. Mounting every section of the tower requires a mounting assembling support.

The present invention overcome the drawbacks of the prior art by providing tower or chimney erecting method. Particularly, the present invention provides a method for erecting a pre-stressed concrete tower comprising:

(a) building a tower foundation;

(b) fabricating at tower's building site or at a shop, a plurality of pre-fabricated concrete segments these pre-fabricated elements having internal vertical and horizontal ducts for introducing pre-stressing tendons (FIGS. 2, 3 and 4) and accessories or fits;

(c) fabricating a plurality of assembling supports 40, and lifting harnesses 50 for proving a support to the concrete segments when assembled in tower sections. the assembling support also providing scaffolds for working personnel to safely work at the tower heights;

(d) on the floor lever install an assembling support on a leveled platform;

(e) installing with a crane of medium or low capacity, the concrete segments to conform the concrete tower section, firmly join the concrete segments through pre-stressing tendons;

(f) engaging a lifting harness to the concrete tower section, lift the whole section of tower, mounting the assembled concrete tower section on the foundation and disengaging the lifting harness and or assembling support;

(g) assembling the following concrete tower sections though the use of assembling supports and mount such tower sections, according to the same routine as for the first tower section;

(h) joining the concrete sections through prestressing tendons to provide a rigid tower;

(i) mounting an adapter ring to adapt cylindrical sections of the tower and join the cylindrical sections to the lower sections of the tower by pre-stressing tendons; and (j) mounting a flange for mounting a nacelle, and mounting a nacelle to the top of the prestressed concrete tower.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE INVENTION

The tower, chimney or pole of the present invention is made of pre-stressed concrete, hereinafter only referred as tower, and it is tapered. The tower is an elongated structure having a cross-section decreasing as a function of the tower height.

Accordingly, the diameter of the base is bigger than the diameter on the top. The tower is annular, that means that the tower comprises an external and internal surfaces and an inner gap. The tower can assume any geometry.

The present invention overcome every drawback of the prior art previously described.

The height of the tower is variable, and in the case of towers for wind or heliostatic generators, such height depends on the capacity of the nacelle or wind generator or solar receiver to be mounted on.

In an embodiment of the invention, the tower includes an elongated tapered structure formed of concrete legs and concrete joining walls. The concrete legs are formed from prefabricated concrete curved segments (hereinafter curved segments 20) whilst the concrete joining walls are formed from prefabricated or pre-cast concrete joining segments (hereinafter joining segments 30).

The curved segments are piled up, to form concrete legs. The curved segments forming concrete legs are joined together with the joining segments, to form tower sections of variable cross-sections that allow the tower to be erected. The tower ends in a circular section at its upper end. The curved segments and the joining segments are joined together and attached to a foundation by pre-stressing tendons. The prefabricated curved and the joining segments, because of their size, are preferably fabricated on-site, thus avoiding the need to be transported.

Figure 10:
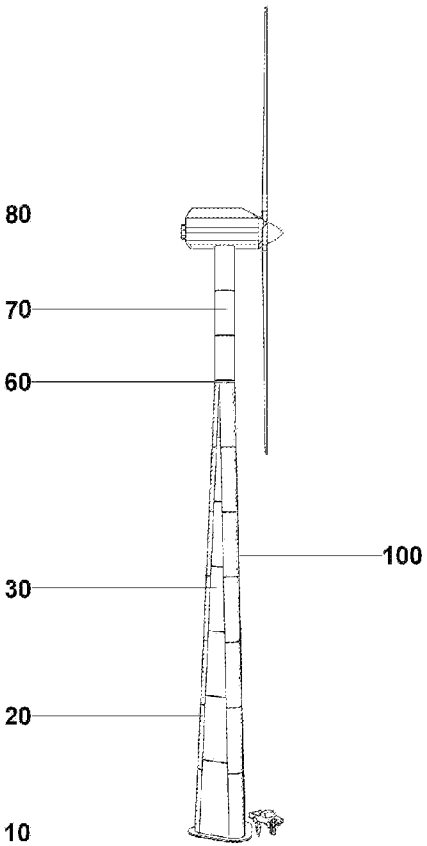
FIG. 10 shows a triangular cross-sectional tower according to an embodiment of the invention

According to the preferred embodiment of the invention, depicted in FIG. 10, the curved segments are designed in such way that at the tower top such segments forms a circular ring. Thus, if the tower is of a triangular cross-section having three concrete legs, the curved segments are of an angle of 120°. Such angle is 90° if the cross section is square with four concrete legs.

According to the preferred embodiment of the invention depicted in FIG. 10, such joining segments 30 of the concrete joining walls consist of concrete joining segments having a form of a truncated triangular (or trapezoidal) slab with a lower wide edge and an upper narrow edge. However, according to another embodiment of the invention, such joining segments cannot be flat but trapezoidal curved ribbed concrete segments. Furthermore, the concrete joining segments cannot include ribs and/or the concrete curved segments can include ribs.

The curved segments are joined to themselves through the joining segments, of a trapezoidal form, in order to form the variable cross-sectioned tower, its upper part being capped by a circular ring.

According to such embodiment, the segmented post-tensioned concrete tower for wind or heliostatic power generators is characterized by the ease of its geometric conception, the curved segments 20 are based on a cylindrical form (constant diameter) split into three equal circular sectors arranged as a tripod to form concrete legs joined to concrete joining walls to form a pyramidal body 100; they have the objective of using only one standard curved mold. The joining segments 30, which complement the tower section, are flat and preferably horizontally fabricated on a concrete template.

The constructive development for the preferred embodiment of the tower, designed in order to have a reinforced and pre-stressed concrete structure in a unique, rapid and economical way, includes a pyramidal body 100 having a plurality of pre-fabricated concrete segments including (i) prefabricated curved segments 20, made of concrete, and (ii) prefabricated joining segments 30, also made of concrete. The tower is slender, having an aesthetic appeal without impairing the structural properties necessary for supporting the loading to which it will be subjected, such as its own weight, the weight and movement of the blades, wind thrust, seismic forces, etc. It has been found that a tower of a triangular cross-section provides an improved resistance to the horizontal loads when compared with towers of square or circular cross-section.

The height of the tower is a function of the wind power generator capacity. The tower's geometry is dimensioned and controlled in order to comply with all extreme conditions of the service, and the ultimate limits in the various current building codes.

According to the present invention, a tower is described comprising a pyramidal body 100 comprising a structure formed by prefabricated curved segments 20, of reinforced- and pre-stressed (post-tensioned) concrete, combined with prefabricated joining segments 30. The cross section of the pyramidal body 100 decreases as a function of its height.

In the preferred embodiment of the invention depicted in FIG. 10, the tower further comprises, two portions distinguishable from each other by their geometry: a lower pyramidal body 100 having a variable cross section from its base to approximately two thirds of its height, and an upper extension body, composed of cylindrical sections 70, preferably having a circular cross-section of constant diameter, which approximately forms one third of the total height of the tower.

In the preferred embodiment of the invention, illustrated in FIG. 10, the pyramidal body 100 of the tower has an axisymmetrical cross section, whose perimeter looks like to a triangle with straight sides and rounded vertices forming the triangular cross-section of the tower. The triangular cross section of at pyramidal body 100 decreases as a function of the tower's height, forming a pyramidal structure, as viewed from a side. It is to say, that it thins out as its height increases.

Figure 9:
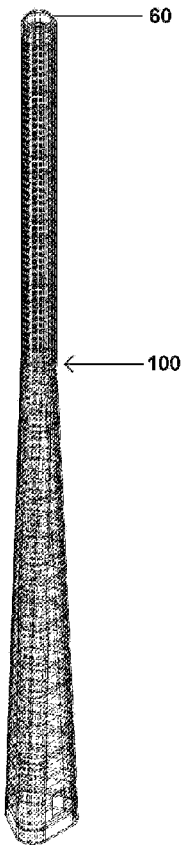
FIG. 9 shows a chimney according to an embodiment of the invention.

As illustrated in FIGS. 9 and 10, the tower of the preferred embodiment comprises three segmented flat joining walls separated in-between, extending between the vertices of the triangular cross-section along the first portion of the tower, forming the concrete joining walls of the tower. Each concrete joining wall comprises a plurality of prefabricated joining segments 30. Whilst each concrete leg comprise a plurality of prefabricated curved segments 20.

Figure 4:
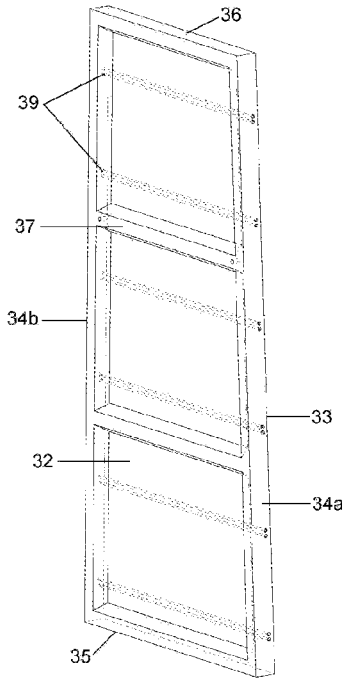
FIG. 4 depicts a concrete flat segment according to an embodiment of the invention.

FIG. 4 depicts a joining segment 30 as a prefabricated flat ribbed segment. The joining segment has an internal face 32, an external face 33, two long sides 34*a*, 34*b*, a bottom side 35, and one upper side 36. Each ribbed segment comprises reinforcing ribs 37. The arrangement of the ribs can be done according to any known method. Preferably, the ribs should extend vertically, horizontally, in crossings, or diagonally and it should also form a framework along the perimeter of the joining segment 30. The joining segments 30 may consist of curved ribbed segments in order to form a circular cross-sectional tower.

Furthermore, the joining segments 30 incorporate vertical and horizontal ducts for running horizontal pre-stressing tendons into them. The horizontal ducts 39 of the joining segments 30 are aligned to the corresponding horizontal ducts 29 of the curved segments 20. Through each of these ducts, at least one pre-stressing tendon is introduced and, by the action of the tendon, the joining segment 30 and curved 20 segments remain fixedly and firmly attached, thereby forming a structure which structural properties are similar to a corresponding monolithic structure.

Figure 11:
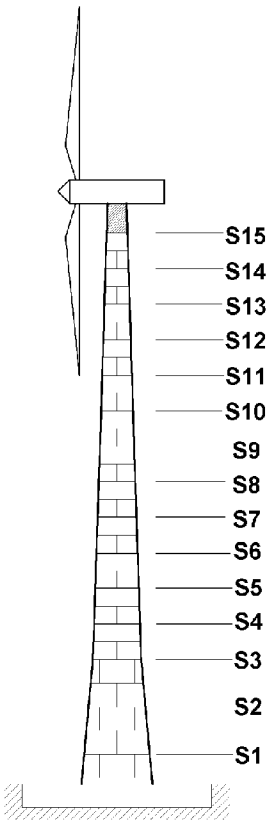
FIG. 11 shows a circular cross-sectional tower for wind or heliostatic generators according to the prior art.

According to the preferred embodiment of the invention, each of the joining segments 30 has an elongated- and trapezoidal form, such that the upper side 36 is narrower than the bottom side 35. As depicted in FIGS. 10 and 11, the joining segments 30 installed at the uppermost part of the triangular cross section in the tower, are of a triangular form (but not trapezoidal). In this portion of the tower, the cross section of it turns circular, because the curved segments 20 are joined and form a complete circumference.

The manufacture of pre-cast concrete segments 20 and 30 is conducted in a working area some hundred meters closed to the tower or chimney. It uses light equipment (cranes) for handling, storing or mounting the concrete segments in an assembling support. Thus, substantial savings are obtained by eliminating the need to transport the segments from the shop to the tower building site. However, as it will be evident for a person skilled in the art, the concrete segments 20 and 30 can be shop-fabricated. Also, the shop can be advantageously located very close to the building site.

Figure 2:
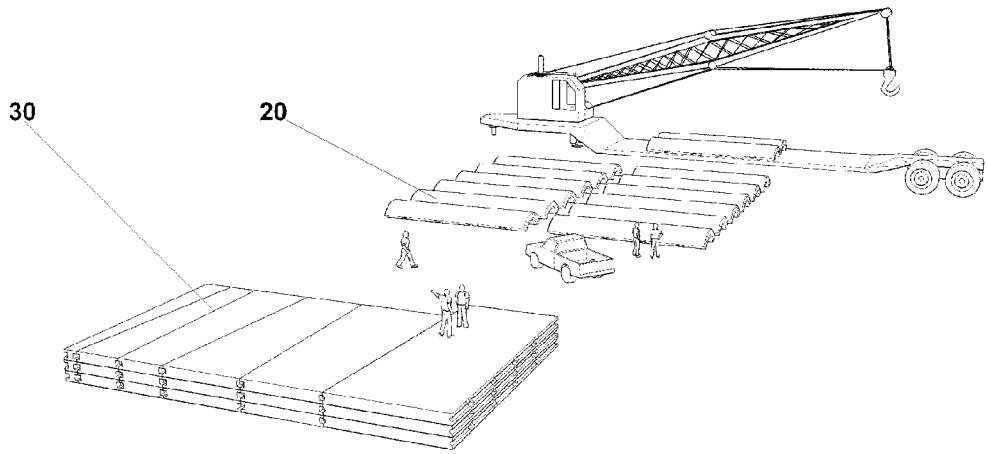
FIG. 2 depicts concrete segments fabricated at or close to the building site.

In the case of use of flat ribbed joining segments, are advantageously employed molds which limit the periphery of segments and ribbings. The flat segments are molded by pouring and curing concrete in layers, over a concrete hardstand or template (FIG. 2). Between layers, a mold releaser is inserted, which prevents the flat segments from sticking together. For convenience, first the flat segments corresponding to the upper sections in the tower are manufactured by pouring and curing; then, the segments for the intermediate sections and finally, the segments for the bottom sections are formed. This way, the flat segments will be lifted and mounted by a crane as the building of the tower proceeds, without needing to move the flat segments which have already been cast and lie in the lower layers.

Before pouring the concrete, it is possible to include attachments or fits to the flat segments for allowing, for example, ducting for electrical installation. Also, the ducts for the pre-stressing tendons are incorporated.

As it will be apparent from the figures, the joining segments 30 are mounted with their ribbing facing towards the tower's interior, while the smooth face forms the exterior surface of the tower. However, the ribbed face of the flat segments can be selected to be the external surface of the tower.

According to the embodiment depicted in FIGS. 9 and 10, the tower comprises three concrete legs, separated from each other, extending along the tower in the vertices of the triangular cross-section, between the joining segments and joined to them. Every concrete leg consists of a plurality of prefabricated curved segments 20, made of concrete that are stacked vertically and post-tensioned.

As will be apparent in FIGS. 10 and 11, the concrete legs are placed, between the joining walls at the vertices of the tower's triangular cross-section. The concrete legs and the joining walls extend along the pyramidal body 100 of the tower.

The reduction in the tower's cross section is achieved by gradually reducing the width of the joining segments 30, but without modifying the dimension of the curved segments 20, until the curved segments 20 converge forming a circular ring. See FIGS. 10, 11. Also, the tower optionally includes an adapter 60, the adapter having the task of uniformly distributing the vertical loads onto the concrete legs.

The curved segments 20 of the concrete legs of the tower are pre-fabricated preferably on-site. According to the present invention, the curved segments 20 are foreseen having the same dimensions and form. Their form is that of a circular cylinder segment of 120°. This approach, in contrast to towers built according to prior art, does not require special molds to manufacture each segment of the tower.

According to an embodiment, only one type of mold can be used to fabricate all curved segments 20. When a section is formed from six segments, the weight of the concrete segments approximately ⅙ of the total weight of a complete section. Thus, for mounting the segments it is required a crane of approximately ⅙ of the capacity required when complete sections is mounted. Such a difference in weight allows a safer and easier assembly of the prefabricated concrete segments in sections and requires a less expensive crane. Such feature is also beneficial for off-shore applications.

Figure 3:
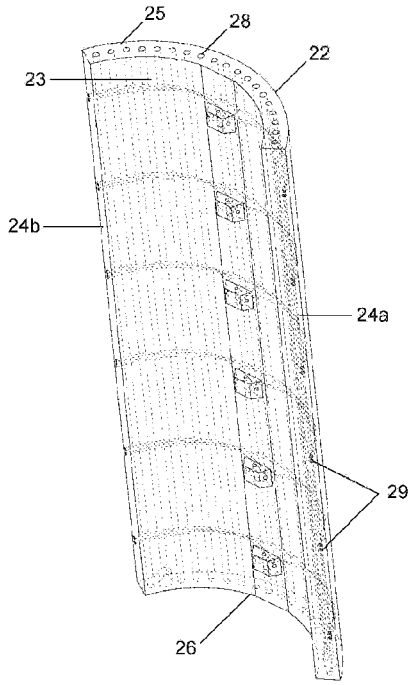
FIG. 3 depicts a concrete curved segment according to an embodiment of the invention.

FIG. 3 illustrates a curved segment 20. The segment has an external face 22 and an internal face 23, and has two lateral edges 24*a*, 24*b* of a suitable thickness. Also, the curved segments 20 have an upper or top side 25, and a bottom side 26, along the surface of the segment 20, parallel to the edges 24*a*, 24*b* there is a plurality of horizontal ducts 29 and vertical ducts 28, for introducing the pre-stressing cables into the horizontal ducts 29 of the curved segments 20, and into the horizontal ducts 39 of the adjacent joining segments 30, pre-stressing cables are introduced and secured, for joining the curved segments 20 to the adjacent joining segments 30. Also, the pre-stressing tendons are introduced into the vertical ducts 28 of curved segments 20, in order to join the overlying and underlying curved segments to form the concrete legs. The vertical and horizontal pre-stressing tendons are introduced and secured by means and methods well known to those skilled in the art.

Another non depicted embodiment of the tower comprises towers of elliptical or polygonal cross-section having curved joining walls. The method of the present invention is also applicable to towers of circular cross section depicted in FIG. 11. Such tower lacks of concrete legs.

The pre-stressing tendons (not depicted) are selected from pre-stressing cables or strands made of high tensile strength steel; or rods or any suitable pre-stressing element, anchored to the tower's foundation, which are installed and post-tensioned inside the concrete segments in order to provide the continuity of the tower sections, for example as illustrated in JP U3074144 to Nakai.

Sidewise, the curved segments 20 are connected to the joining segments 30 by vertical pre-stressing cables, thus allowing to operate as an integral- or monolithic section. To that end, the curved segments comprise horizontal ducts which are aligned to corresponding ducts in the joining segments 30.

Once the tower is built and is operating, the concrete legs provide resistance against vertical loads, mainly the loads due to the tower own weight and nacelle weight whilst the combination of curved and flat segments provide the resistance against the horizontal loads mainly due to the movement of the wind power generator blades, the wind thrust and the seismic forces.

According to the present invention, a considerably lower quantity of molds can be used, in contrast to those used in the building methods for circular tapered stack-type towers according to the prior art.

Figure 1:
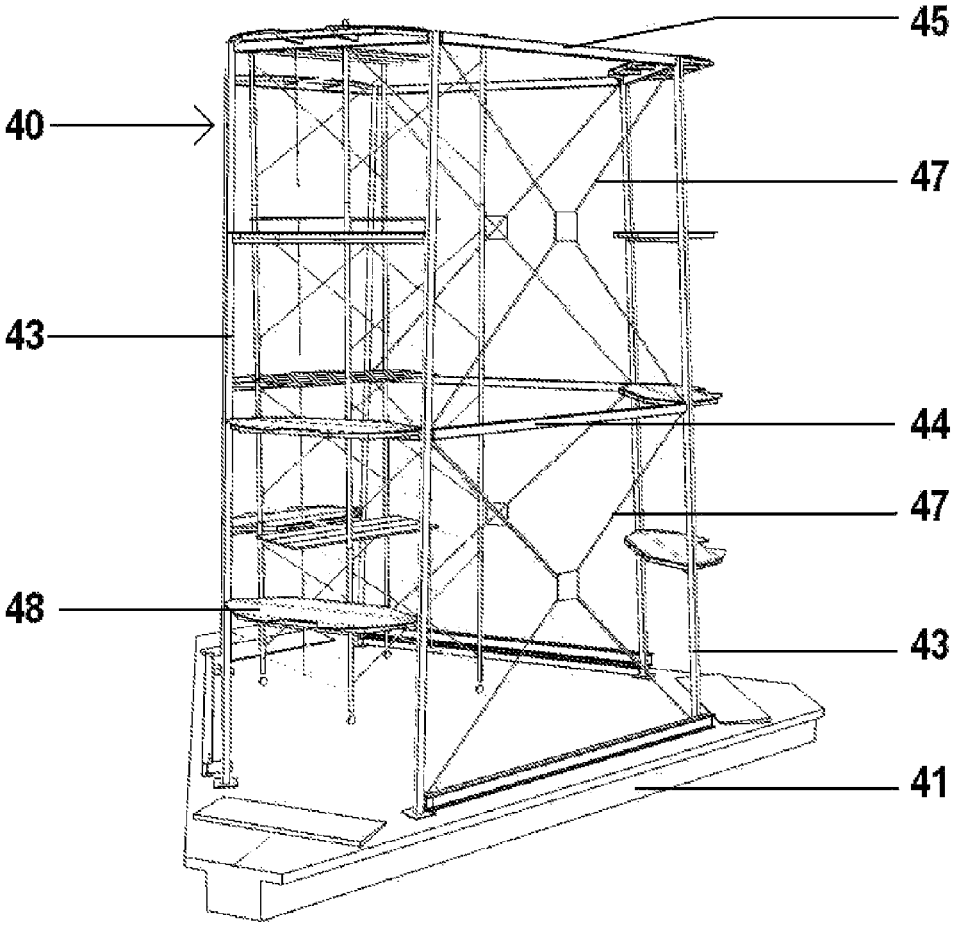
FIG. 1 shows the tower section assembling support for assembling a tower section.
Figure 5:
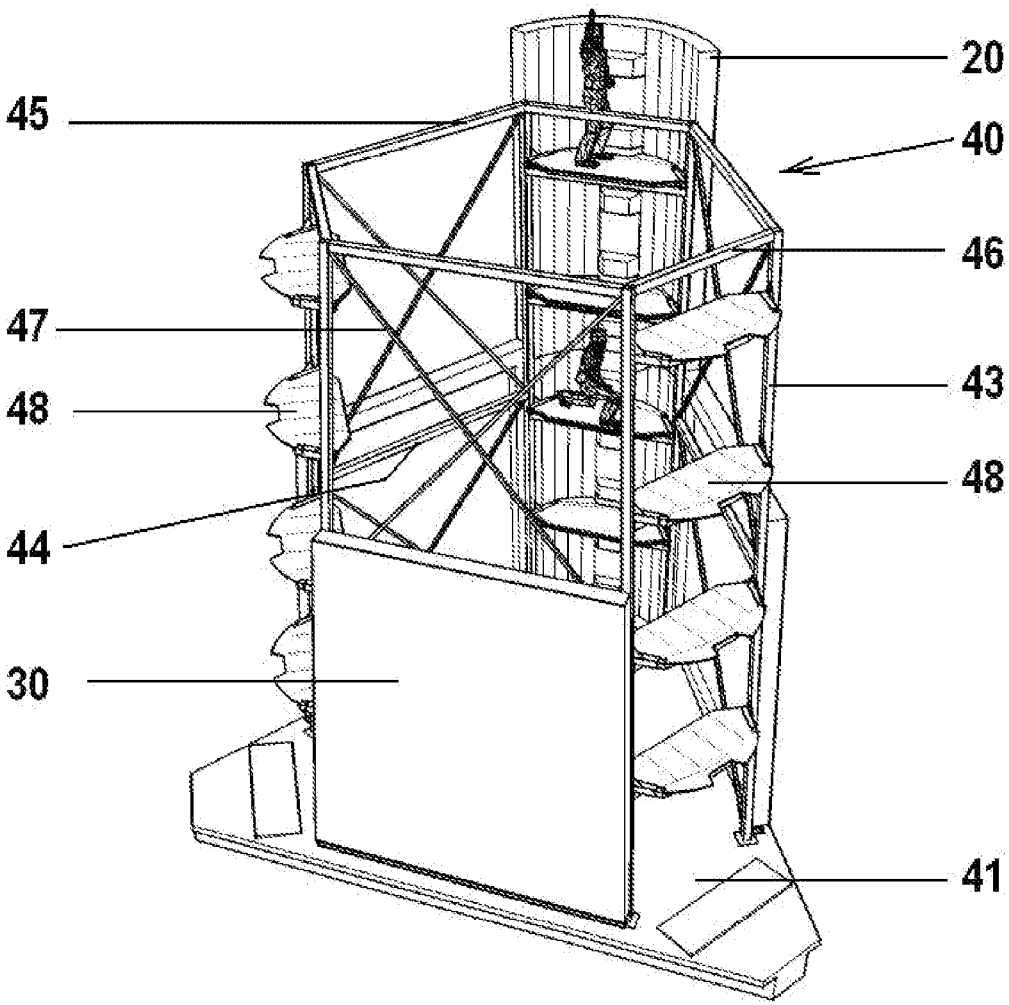
FIG. 5 depicts the process of assembling a tower concrete section.

That simplified mounting operation is reach through the use of the tower section assembly support 40 of the invention depicted in FIGS. 1 and 5. Such assembly support 40 comprises a concrete light base 41 and an structure or armor, to enable the transportation of sections to the tower foundation and erection of the tower section by section.

As shown in FIGS. 1 and 5, the assembling support 40 comprises a platform 41 and a structure or armor consisting of a plurality of posts 43 erected and detachably attached to the platform 41 and beams 44 and 46 forming a first lower ring, and beams 45 and 46 forming a second upper ring, each end of the beams being joined to a post 43 to form an erected polygonal self supporting structure able to support radial loads. According to the embodiment depicted in FIGS. 1 and 5, the assembling support 40 comprises two rings of six beams. Due to the fact that the joining segments are tapered, the assembling support adjacent to the joining segments, are also tapered. The beams 44 placed on the lower level are larger than beams 45 placed on the upper level, thus providing a first ring wider than the second ring. However, due to the fact that the curved segments 20 are not tapered, the upper and lower beams 46, adjacent to the curved segments, are of the same size. The assembling support 40 further includes a plurality of beams 46 only joined to two adjacent posts at different height of the posts;

The assembling support 40 comprises a plurality of scaffolds 48 firm and conveniently attached to beams 46 at different heights. Such scaffolds are intended to provide a security for workers that allow them safety pre-stressing and conditioning the concrete section when (a) such sections are assembled from the concrete segments, and (b) when the tower sections are mounted and joined to precedent sections in order to erect the tower.

The assembling support 40 is light and it can be easily transported. Thus when a wind energy park is being built, the assembling support 40 can be used several times.

The assembling support includes scaffolds 48, hooks and stairs required for the use of working personnel in order to pre-stress the concrete sections.

According to the present invention the sections are lift and mounted through the use of a lifting harness 50. A lifting harness 50 in use is depicted in FIGS. 6, 7 and 8.

The lifting harness 50 is secured to the pres-stressed concrete section and it is intended for distributing the weight of the concrete section.

Figure 6:
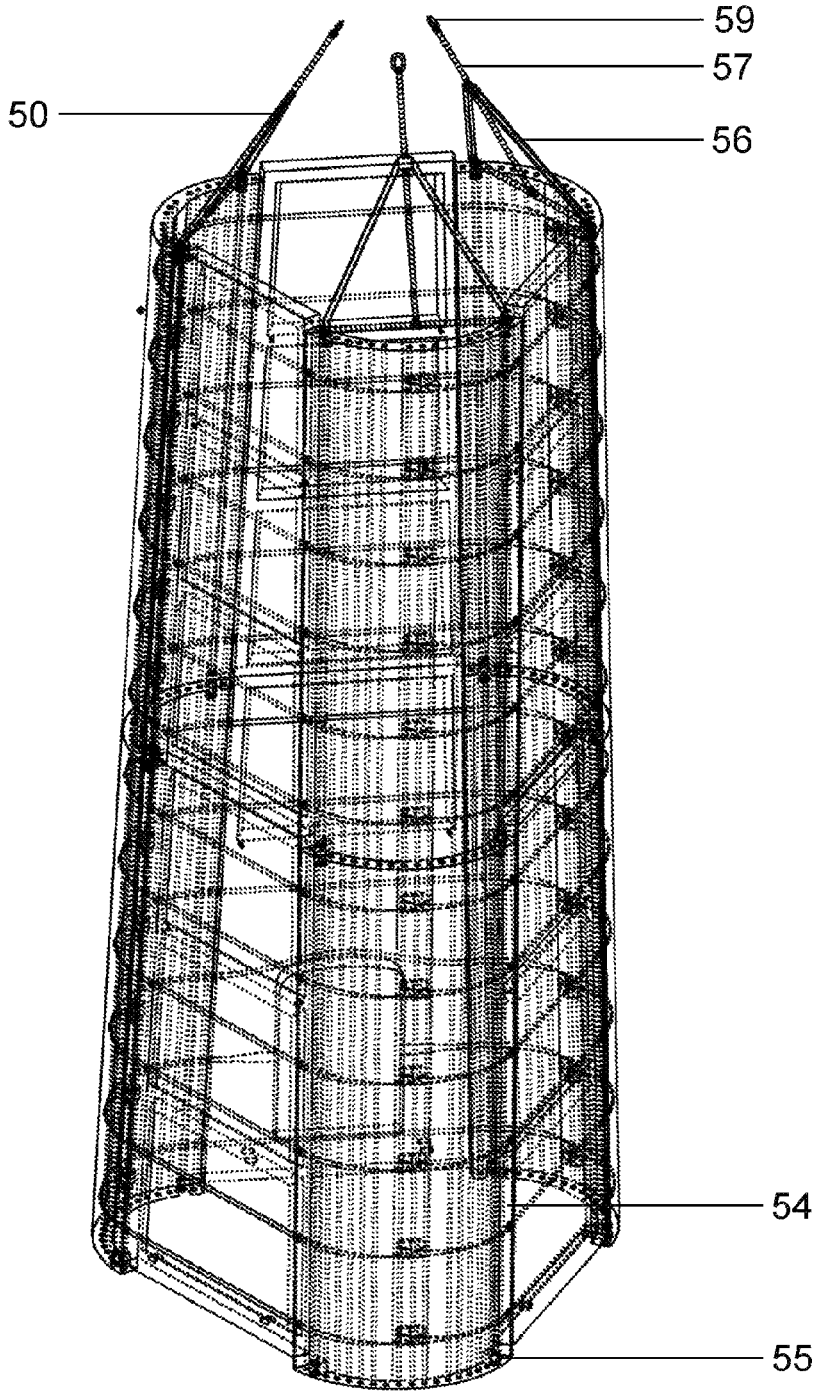
FIG. 6 depicts an assembled section of the tower or chimney, the section further including a lifting harness for mounting.
Figure 7:
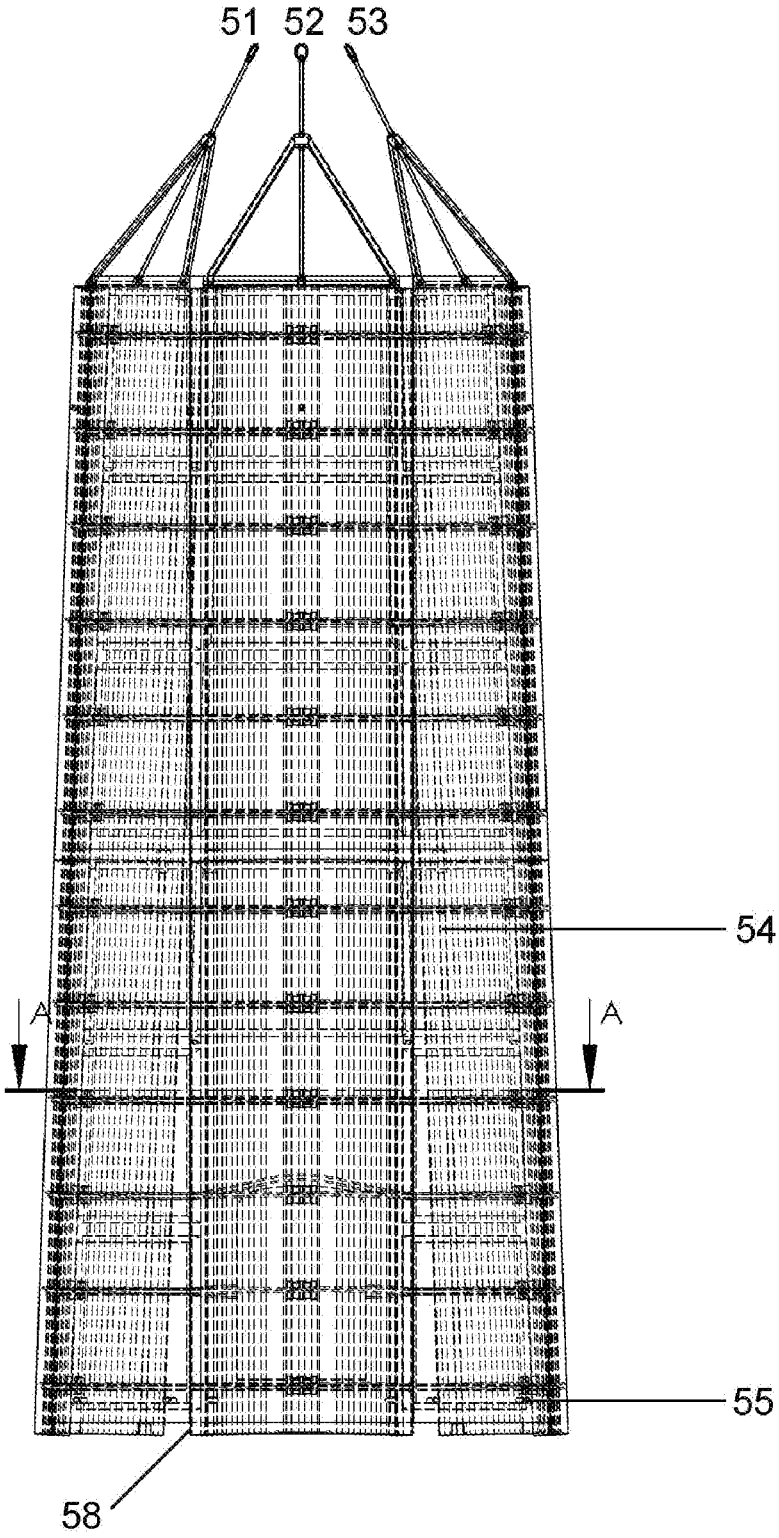
FIG. 7 shows a lifting harness engaged to the concrete section
Figure 8:
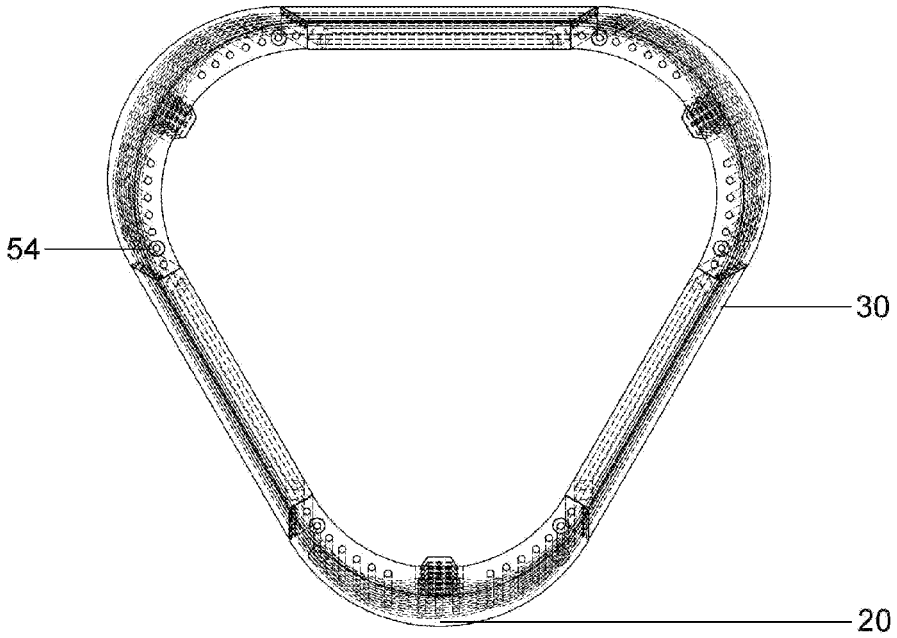
FIG. 8 shows a top view of the tower section and harness ready for mounting.

As depicted in FIGS. 6, 7 and 8 the lifting harness 50 comprises at least one but preferably a plurality of elongated rods or strands 54 having a lower end joined to securing means such as a plate and a nut 55 to be secured to the threaded lower end of the elongated rods or strands 54. The upper end of the elongated rods or strands 54 being joined to a distributor 56 such that two or more rods 54 can transfer loads to a bar 57 comprising a loop or ring 59 in its upper end. As noted from FIGS. 7 and 8, the embodiment depicts lifting harnesses 51, 52 and 53, in order to be lifted by a three prong hook attached to the crane (not depicted).

According to the mounting method of the invention, a plurality of assembling supports 40 is built for each section to be assembled and mounted. Such assembling support 40 sharing the above disclosed features.

Under an embodiment of the invention, each assembling support (40) is leveled through the use of supporting beams which distribute the weight of the sections in order to reach stability. Then, the posts 43 and beams 44, 45 and 46 are joined to erect the assembling support 40 on the leveled platform 41.

After that, the pre-casted concrete segments are place and tilt in the corresponding assembling support. Then, such concrete segments are joined together by horizontal prestressing. Such assembly of the tower sections is repeated for each section.

In order to assemble a tower section, the concrete segments are leant and tilt to the assembling support 40 as shown in FIG. 5. Then, pre-stressing tendons are introduced into the ducts in order to provide horizontal pre-stressing to the tower section. Once the section is prestressed, the assembled section acquire properties as a monolithic structure, the section can then be lifted and mounted to its final position.

As shown in FIG. 5, the tower section is composed of two semi-sections, composed each of six concrete segments. In such embodiment, it is also necessary to provide vertical pre-stressing between upper and lower segments in order to join both semi-sections. An embodiment of the invention consists of a triangular cross-sectional concrete tower section made from three curved concrete segments and three flat joining concrete segments.

As it could be obvious for a skilled in the art a tower section can be composed of two, three, four, five six, seven or more segments. Such segments being flat or curved, for example the segments required to erect the tower depicted in FIG. 11. According to the embodiment of FIG. 11, the lower segments of the circular tapered concrete tower are composed of four concrete segments whilst the intermediate and upper sections are respectively composed of three and two concrete segments. It is considered that the assembling support 40 of the invention can be advantageously used in erecting such tower. The number of posts 43 and beams 44, 45, 46 of the assembling support 40 is determined by the number of segments composing the tower section.

Beams 44, 45, 46 and posts 43 are joined together by welding or bolts. In addition the assembling support include reinforcing means 47 as reinforcing rods to improve the rigidity of the assembling support 40.

The assembling support 40 allows assembling tower sections from concrete segments. Due to the fact that the concrete tower is tapered, the number of assembling supports 40 depends on the concrete sections to be mounted. According to the tower and chimney depicted in FIGS. 9 and 10, the tower consists of seven tapered sections. According to the embodiment of F*ig*.11, the tower comprises 15 tapered sections (S1 to S15).

Once the concrete tower sections are assembled, the assembling support 40 can be releasable attached to the concrete section. Then, the complete sections are lifted and mounted into its tower position through the use of a high capacity crane. The operation of a high capacity crane is conveniently scheduled to carry out a continuous operation. For such purposes, the lifting harness 50 comprises means to easily deliver the segments from the harness.

For such purpose, the elongated rods or strands 54 of the lifting harness 40 are introduced in the vertical presstresing ducts of the concrete segments. In the embodiment of the invention depicted in the figures, the elongated rods 54 of the lifting harness 50 are introduced in the curved segments 20 which in turn form the concrete legs of the tower. Such curved segments 20 are stronger than the joining segments 30, and can support the weight of the flat joining segments. However as it could be obvious for a skilled in the art, the rod 54 of the lifting harness can be extended along of the whole number of concrete segments.

The concrete segments include hollows in its lower part. Such hollows are intended for securing and releasing the lifting harness 50 to the concrete segments assembled as a section. According to the embodiment depicted in FIGS. 6, 7 and 8 the lower threaded end of elongated rods 54 of the lifting harness 50 are secured to the concrete segments by plates and bolts.

The assembled tower sections—including the assembling support 40 attached—one by one are then lifted by a high capacity crane and mounted to its final position.

Then, the lifting harness 50 is disengaged from the tower section by releasing the nuts jointed to the rods 54, the nuts are removed from the hollows in the lower ends of the pre-stressing ducts of the concrete segments. The scaffolds of the assembling support 40, allow the working personnel to disengage the lifting harness 50 and to perform the vertical pre-stressing in order to connect the sections of the tower.

The assembling support 40, still connected to the tower section, allows the working personnel to safely work inside the tower.

The sequence is repeated to form the third and following sections of the tower. FIGS. 9 and 10 depict a finished pyramidal body 100 of the tower, having seven sections S'1, S'2, S'3, S'4, S'5, S'6 and S'7. The concrete legs of a tower section can be composed from one or more curved segments. Thus, in one embodiment of the invention, one tower section comprises three flat segments and nine curved segments being the height of the curved segments around ⅓ of the flat segments In another embodiment, consisting of a pyramidal triangular tower, one tower section comprises three flat segments and three curved segments. It is preferred that the flat segments be placed in such a way that it provides a step 58 (FIG. 7, 9) which advantageously allows joining the segments of the first section with the segments of the upper section and/or lower section.

Once the pre-stressing step is performed the assembling support 40 is removed from the tower and then used for assembling the sections of a second tower.

The joining segments of the upper section S'7 depicted in FIG. 10, consist of concrete slabs triangular in shape but not trapezoidal, since at the top the curved sections converge in a ring. Evidently, the number of tower sections depends on the tower's height and of the dimensions of the flat segments; thus, the number of sections and the number of flat and curved segments for each section depends on the tower's design, as will be evident to a person skilled in the art. All of such possible designs are included within the scope of present invention.

Both the curved 20 and joining 30 concrete segments are prefabricated in units, suitable for their mounting, joined together and to the foundation by means of pre-stressing tendons.

According to an embodiment of the invention, the concrete section includes a step useful for mounting the upper tower sections. Such step results of providing concrete segments at different heights than adjacent segments. As depicted in FIGS. 5 and 6, the flat joining segments 30 are placed at different height than the curved segments 20.

For assembling the tower sections, a light crane (low or medium capacity) is used whilst for mounting the tower sections a high capacity crane is required. The rental cost of the cranes influences the cost of the tower. Thus, by the method of the invention, most of the crane time is spent in assembling sections using the cheaper crane whilst the high capacity and expensive crane is used in assembling section which consumes less time. The use of the expensive crane can be conveniently scheduled.

According to an embodiment of the invention, which is illustrated in FIG. 10, the tower includes an extension 70. Preferably, the tower extension 70 includes a cylindrical body. The cylindrical portion can be made of a metallic column, a one-piece cylindrical section made of concrete or preferably a sectioned cylindrical section 70 made of prestressed concrete, which joins to the adapter 60. Also, according to the invention, the upper end of the cylindrical extension comprises one ring (no illustrated) which serves as a flange to support the nacelle 80.

In the preferred embodiment of the invention, the extension 70 includes a plurality of cylindrical sections, made of prestressed concrete, joined together by pre-stressing tendons such as cables or strands, installed and post-tensioned within the ducts of said cylindrical modules (not illustrated). The hybrid towers for wind generators of the prior art usually comprises extensions made of metal, such hybrid towers include such metallic extension in order to absorb the vibration of the tower that can came into resonance and collapse the tower. The vertical and horizontal pre-stressing of the tower of the present invention produce a tower having mechanical properties as a monolithic structure such tower cannot collapse by the vibration of the nacelle and horizontal loads due to wind. Thus, the cylindrical extension of the tower can be preferably made of concrete. A cylindrical concrete extension provides improved structural and environmental strength with regard to the metallic extensions of the hybrid towers of the prior art.

According to the above mentioned embodiment of this invention, the cylindrical sections which form the extension 70 are foreseen as having equal dimensions. In this way, only one type of cylindrical mold is required. As will be apparent to a person skilled in the art, one physical mold is not exclusively used, but a plurality of molds having the same characteristics. The molds can be used to fabricate and erect several towers in a wind power energy farm.

According to present invention, the cylindrical sections of the extension 70 can be fabricated simultaneously to the erection of the tower, being lifted at the proper time by means of a crane, laid on the tower, and fastened to it by mean of pre-stressing tendons, such as cables or strands, which are laid, ducted and post-tensioned inside the prefabricated concrete segments, in a way known to an person skilled in the art.

The molds for cylindrical segments are conditioned, incorporating ducts for pre-stressing cables or strands and other attachments, and then the concrete is poured vertically; the molds can be removed form the casted concrete segment at the next day. Thus, the molds are used every other day. The quantity of molds can be unlimited, and the number of units to be used depends on the magnitude of the construction and on its building schedule.

The wind or heliostatic power generator erecting method comprises the following steps:

(a) to build one foundation for the tower;

(b) to fabricate, at tower's building site or at a shop, a plurality of pre-fabricated concrete segments these pre-fabricated elements having internal vertical and horizontal ducts for introducing pre-stressing tendons (FIGS. 2, 3 and 4) and accessories or fits;

(c) to fabricate a plurality of assembling supports 40, and lifting harnesses 50 for proving a support to the concrete segments when assembled in tower sections. the assembling support also providing scaffolds for working personnel to safely work at the tower heights.

(d) on the floor lever install an assembling support on a leveled platform.

(e) to install, with a crane of low or medium capacity, the concrete segments to conform the concrete tower section, firmly join the concrete segments through pre-stressing tendons.

(f) to engage a lifting harness to the concrete tower section, lift the whole section of tower, mount such concrete section on the foundation and disengage the lifting harness and or assembling support.

(g) to assemble the following concrete tower sections though the use of assembling supports and mount such tower sections, according to the same routine as for the first tower section;

(h) to join the concrete sections through prestressing tendons to provide a rigid tower;

(i) optionally, mounting an adapter ring to adapt cylindrical sections of the tower and join the cylindrical sections to the lower sections of the tower by pre-stressing tendons;

(j) to mount a flange for mounting a nacelle, and mounting a nacelle to the top of the prestressed concrete tower.

The mounting operation of the present invention is simplified due to the fact that a low-medium capacity crane is used for mounting the segments which conforms a tower concrete section, whilst a high capacity crane is used only for mounting the assembled sections of the tower. (See FIG. 3)

It has been stated that the concrete legs converge into a circular ring, however, as it can be obvious for a person skilled in the art the concrete legs can converge in a ring of any suitable geometry. For example, an elliptical, square of polygonal ring. It is also possible that the concrete legs converge in a circular form and then an adapter produces other geometry to adjoin the extension 70, for example bodies of triangular sections. As mentioned before, a tower built using a triangular cross-section provides an improved resistance to the horizontal loads if compared with the towers of square or circular cross-section and it is preferred.

The tower of the present invention does not include any cemented joint. The concrete segments are joined only through prestressing means.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for erecting a pre-stressed sectionalized and segmented concrete tower, which includes a plurality of concrete tower sections, the method comprising the steps of:

building a tower foundation;

assembling a first concrete tower section of the plurality of concrete tower sections, the step of assembling the first concrete tower section comprising the steps of:

fabricating a plurality of concrete segments having internal vertical and horizontal ducts for introducing pre-stressing tendons;

fabricating an assembling support and a lifting harnesses for providing a support to the plurality of concrete segments when assembled in the first concrete tower section, wherein the assembling support includes a plurality of scaffolds;

rigidly securing said plurality of scaffolds for workers at different heights along a longitudinal axis of the first concrete tower section to allow the workers to safely pre-stress and condition the first concrete tower section when assembling the plurality of concrete segments;

installing with a crane, the plurality of concrete segments on the assembling support to form the first concrete tower section;

engaging and securing the lifting harness to the first concrete tower section;

lifting the first concrete tower section with the lifting harness;

mounting the first concrete tower section on the tower foundation;

disengaging the lifting harness from the first concrete tower section;

assembling a remainder of the plurality of concrete tower sections through the use of assembling supports and mounting the remainder of the concrete tower sections one by one through the use of lifting harnesses according to the same steps of assembling the first concrete tower section; and joining the plurality of concrete tower sections through vertical pre-stressed tendons to provide a rigid tower, wherein the assembling supports used for assembling the plurality of concrete tower sections are fabricated independently of each other according to each concrete tower section to be assembled.

2. The method for erecting a pre-stressed sectionalized and segmented concrete tower according to claim 1, wherein the tower has an extension including a cylindrical body, the method further comprising the steps of providing a plurality of cylindrical sections to form the cylindrical body;

mounting an adapter ring to adapt the plurality of cylindrical sections of the tower; mounting the cylindrical body to a top of the plurality of concrete tower sections; joining the cylindrical body to lower sections of the tower by pre-stressing tendons; and mounting a flange for mounting a nacelle, and mounting the nacelle to a top of the prestressed concrete tower.

3. The method for erecting a pre-stressed sectionalized and segmented concrete tower according to claim 1, wherein the lifting harness includes a plurality of bars, each of the plurality of bars includes a load distributor having more than one rod secured to the corresponding assembled concrete tower section.

4. The method for erecting a pre-stressed sectionalized and segmented concrete tower according to claim 3, wherein the lifting harness comprising:

a plurality of elongated strands having a lower end and an upper end, the strands being configured to run along the ducts for pre-stressing tendons, the lower end of the strands being releasable secured through a plate and a nut to a lower portion of one concrete segment and the upper end being joined to the distributors such that more than one rod of each distributor can transfer loads to the bar having a loop or ring attached in an upper end thereof.

5. The method for erecting a pre-stressed sectionalized and segmented concrete tower according to claim 1, wherein the assembling support comprising:

an erected polygonal self-supporting structure configured to support radial loads, the erected polygonal self-supporting structure comprising:

a platform;

a plurality of posts erected and detachably attached to the platform;

a plurality of beams configured to form a first ring and a second ring, each end of the beams being joined to a corresponding one of the plurality of posts; each of the plurality of beams being only joined to two adjacent posts and the plurality of beams being arranged at different heights along an longitudinal axis of the assembling support;

the plurality of scaffolds firmly attached to beams at different heights to provide secure scaffolds for workers that allow the workers to safely pre-stress and condition the concrete tower section when such sections are assembled from the concrete segments, and when the tower sections are mounted and joined to precedent sections in order to erect the tower.

6. A method for erecting a pre-stressed sectionalized and segmented concrete tower, which includes a plurality of concrete tower sections, the method comprising the steps of:

building a tower foundation;

assembling a first concrete tower section of the plurality of concrete tower sections, the step of assembling the first concrete tower section comprising the steps of:

fabricating a plurality of concrete segments having internal vertical and horizontal ducts for introducing pre-stressing tendons;

fabricating an assembling support and a lifting harnesses for providing a support to the plurality of concrete segments when assembled in the first concrete tower section, wherein the assembling support includes a plurality of scaffolds;

rigidly securing said plurality of scaffolds for workers at different heights along a longitudinal axis of the first concrete tower section to allow the works to safely prestress and condition the first concrete tower section when assembling the plurality of concrete segments;

installing with a crane, the plurality of concrete segments on the assembling support to form the first concrete tower section;

engaging and securing the lifting harness to the first concrete tower section;

lifting the first concrete tower section with the lifting harness;

mounting the first concrete tower section on the tower foundation;

disengaging the lifting harness from the first concrete section;

assembling a remainder of the plurality of concrete tower sections through the use of assembling supports and mounting the remainder of the concrete tower sections one by one through the use of lifting harnesses according to the same steps of assembling the first concrete tower section; and joining the plurality of concrete tower sections through vertical pre-stressed tendons to provide a rigid tower, wherein the tower has an extension including a cylindrical body, the method further comprising the steps of providing a plurality of cylindrical sections to form the cylindrical body;

mounting an adapter ring to adapt the plurality of cylindrical sections of the tower; mounting the cylindrical body to a top of the plurality of concrete tower sections; joining the cylindrical body to lower sections of the tower by pre-stressing tendons; and mounting a flange for mounting a nacelle, and mounting the nacelle to a top of the prestressed concrete tower.

7. A method for erecting a pre-stressed sectionalized and segmented concrete tower, which includes a plurality of concrete tower sections, the method comprising the steps of:

building a tower foundation;

assembling a first concrete tower section of the plurality of concrete tower sections, the step of assembling the first concrete tower section comprising the steps of:

fabricating a plurality of concrete segments having internal vertical and horizontal ducts for introducing pre-stressing tendons;

fabricating an assembling support and a lifting harnesses for providing a support to the plurality of concrete segments when assembled in the first concrete tower section, wherein the assembling support includes a plurality of scaffolds;

rigidly securing said plurality of scaffolds for workers at different heights along a longitudinal axis of the first concrete tower section to allow the works to safely prestress and condition the first concrete tower section when assembling the plurality of concrete segments;

installing with a crane, the plurality of concrete segments on the assembling support to form the first concrete tower section;

engaging and securing the lifting harness to the first concrete tower section;

lifting the first concrete tower section with the lifting harness;

mounting the first concrete tower section on the tower foundation;

disengaging the lifting harness from the first concrete section;

assembling a remainder of the plurality of concrete tower sections through the use of assembling supports and mounting the remainder of the concrete tower sections one by one through the use of lifting harnesses according to the same steps of assembling the first concrete tower section; and joining the plurality of concrete tower sections through vertical pre-stressed tendons to provide a rigid tower, wherein the lifting harness includes a plurality of bars, each of the plurality of bars includes a load distributor having more than one rod secured to the corresponding assembled concrete tower section.

* * * * *